US011624491B2

(12) United States Patent
Kim

(10) Patent No.: US 11,624,491 B2
(45) Date of Patent: Apr. 11, 2023

(54) LAMP FOR VEHICLE

(71) Applicant: HYUNDAI MOBIS CO., LTD., Seoul (KR)

(72) Inventor: Seok Huyn Kim, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/535,130

(22) Filed: Nov. 24, 2021

(65) Prior Publication Data

US 2023/0038249 A1 Feb. 9, 2023

(30) Foreign Application Priority Data

Aug. 9, 2021 (KR) ..... 10-2021-0104814

(51) Int. Cl.

| | |
|---|---|
| ***F21S 43/40*** | (2018.01) |
| ***F21S 43/15*** | (2018.01) |
| ***F21S 43/14*** | (2018.01) |
| ***F21S 43/50*** | (2018.01) |

(52) U.S. Cl.

CPC ..... *F21S 43/40* (2018.01); *F21S 43/15* (2018.01); *F21S 43/14* (2018.01); *F21S 43/51* (2018.01)

(58) Field of Classification Search

CPC .. F21S 43/15; F21S 43/14; F21S 43/51; F21S 43/40

See application file for complete search history.

(56) References Cited

U.S. PATENT DOCUMENTS

| | | | | |
|---|---|---|---|---|
| 10,145,537 | B2 * | 12/2018 | Watanabe | F21S 43/14 |
| 10,890,308 | B2 * | 1/2021 | Jung | F21S 43/195 |
| 11,027,658 | B2 * | 6/2021 | Kim | F21S 43/27 |
| 2005/0078486 | A1 * | 4/2005 | Kawaguchi | F21S 43/40 362/494 |

FOREIGN PATENT DOCUMENTS

| | | |
|---|---|---|
| JP | 2013-182872 A | 9/2013 |
| JP | 2013-214492 A | 10/2013 |

OTHER PUBLICATIONS

Office Action dated Dec. 13, 2022 in corresponding Korean Patent Application No. 10-2021-0104814.

* cited by examiner

*Primary Examiner* — Matthew J. Peerce
(74) *Attorney, Agent, or Firm* — NovoTechIP International PLLC

(57) ABSTRACT

Disclosed is a lamp for a vehicle. The lamp for a vehicle includes a lamp housing, a bezel part housed in the lamp housing, a light source part including a board positioned in the bezel part, and a plurality of light sources positioned on the board, a lens part positioned on the lamp housing, and that externally irradiates light generated by the light source part, and a reflection part positioned on a rear side corresponding to an opposite direction to a front side that faces the lens part from the light source part to be spaced apart from the light source part, and that reflects the light irradiated from the light source part to the front side, and the board is formed of a transparent material having light transmittance such that a portion of the light generated by the plurality of light sources reaches the reflection part.

11 Claims, 6 Drawing Sheets

30

LAMP FOR VEHICLE

CROSS-REFERENCE TO RELATED APPLICATIONS

This application claims the benefit of priority to Korean Patent Application No. 10-2021-0104814, filed in the Korean Intellectual Property Office on Aug. 9, 2021, the entire contents of which are incorporated herein by reference.

BACKGROUND OF THE INVENTION

1. Field of the Invention

The present disclosure relates to a lamp for a vehicle, and more particularly, to a lamp for a vehicle that may implement a three-dimensional lighting pattern.

2. Discussion of Related Art

In general, a lamp for a vehicle is installed on a front side or a rear side of a vehicle, and functions to inform another vehicle or a pedestrian of driving information, such as a location, a driving state, a predicted travel route, and the like, of the vehicle by emitting different lights according to purposes.

Because the lamp for a vehicle greatly influences a design and an image of the vehicle, in recent years, lamps of various designs have been developed in consideration of functional aspects and aesthetic aspects. Also, images implemented by the lamp for a vehicle are made to be various to try differentiated designs. That is, product values are improved by implementing an image having an enhanced detailed feeling and an enhanced three-dimensional feeling as well as by implementing a simple lighting image of a light source. The three-dimensional feeling may be implemented by using a visual recognition difference, such as a binocular disparity, a perspective method, a contrast, and the like.

However, to form a three-dimensional image in a conventional lamp for a vehicle, a large number of light sources are necessary or structures other than light sources are used, and thus, costs are increased. Accordingly, it is necessary to improve a technology of implementing a three-dimensional image at low costs.

BRIEF SUMMARY OF THE INVENTION

The present disclosure has been made to solve the above-mentioned problems occurring in the prior art while advantages achieved by the prior art are maintained intact.

An aspect of the present disclosure provides a lamp for a vehicle that implements a disparity perspective through refraction and reflection of side light irradiated by a light source.

Another aspect of the present disclosure provides a lamp for a vehicle that enhances a three-dimensional feeling and improves visibility through a shape of a reflection part.

Another aspect of the present disclosure provides a lamp for a vehicle that forms a three-dimensional lighting pattern at low costs.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a lamp for a vehicle includes a lamp housing, a bezel part installed in the lamp housing, a light source part including a board installed in the bezel part, and a plurality of light sources mounted on the board, a lens part mounted on the lamp housing, and that externally irradiates light generated by the light source part, and a reflection part installed on a rear side corresponding to an opposite direction to a front side that faces the lens part from the light source part to be spaced apart from the light source part, and that reflects the light irradiated from the light source part to the front side, and the board is formed of a transparent material having light transmittance such that a portion of the light generated by the plurality of light sources reaches the reflection part.

Each of the light sources may include a front surface corresponding to a surface that faces the front side, a rear surface corresponding to a surface that faces the rear side and contacts the board, and a side surface provided between the front surface and the rear surface, and a portion of side light corresponding to light irradiated from the side surface of the light source may be reflected by the board and reaches the reflection part.

The board may have a curved surface that is curved toward the front side.

The board may be a flexible printed circuit board (FPCB).

The reflection part may include a body disposed on a rear side of the board and installed in the bezel part, and a reflection surface formed on a surface that faces a front side of the body, spaced apart from the board, and that reflects the light irradiated from the light source part to the front side.

The reflection surface may be formed by depositing a material that reflects the light.

The reflection surface may have a curved surface that is curved toward the front side.

The board may have a curved surface that is curved toward the front side, and a curvature of the reflection surface may be larger than a curvature of the board.

The board and the reflection surface may be symmetrical to each other with respect to a vertical center surface corresponding to an imaginary surface obtained by extending a central axis passing through a center of the light source part and extending in a direction, in which the light is irradiated by the lamp for a vehicle, in a direction that is perpendicular to a ground surface.

The board and the reflection surface may be asymmetrical to each other with respect to a vertical center surface corresponding to an imaginary surface obtained by extending a central axis passing through a center of the light source part and extending in a direction, in which the light is irradiated by the lamp for a vehicle, in a direction that is perpendicular to a ground surface.

A distance between the board and the reflection surface may be shortest at a center of the light source part.

The lamp for a vehicle may be a rear lamp installed on a rear surface of the vehicle.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION OF THE INVENTION

Hereinafter, embodiments of the present disclosure will be described in detail with reference to the accompanying drawings.

First, the embodiments described herein are embodiments that are suitable for understanding the technical features of a lamp for a vehicle according to the present disclosure. However, the present disclosure is not limited to the embodiment described below or the technical features of the present disclosure are not limited by the described embodiments, and the present disclosure may be variously modified without departing from the technical scope of the present disclosure.

Figure 1:
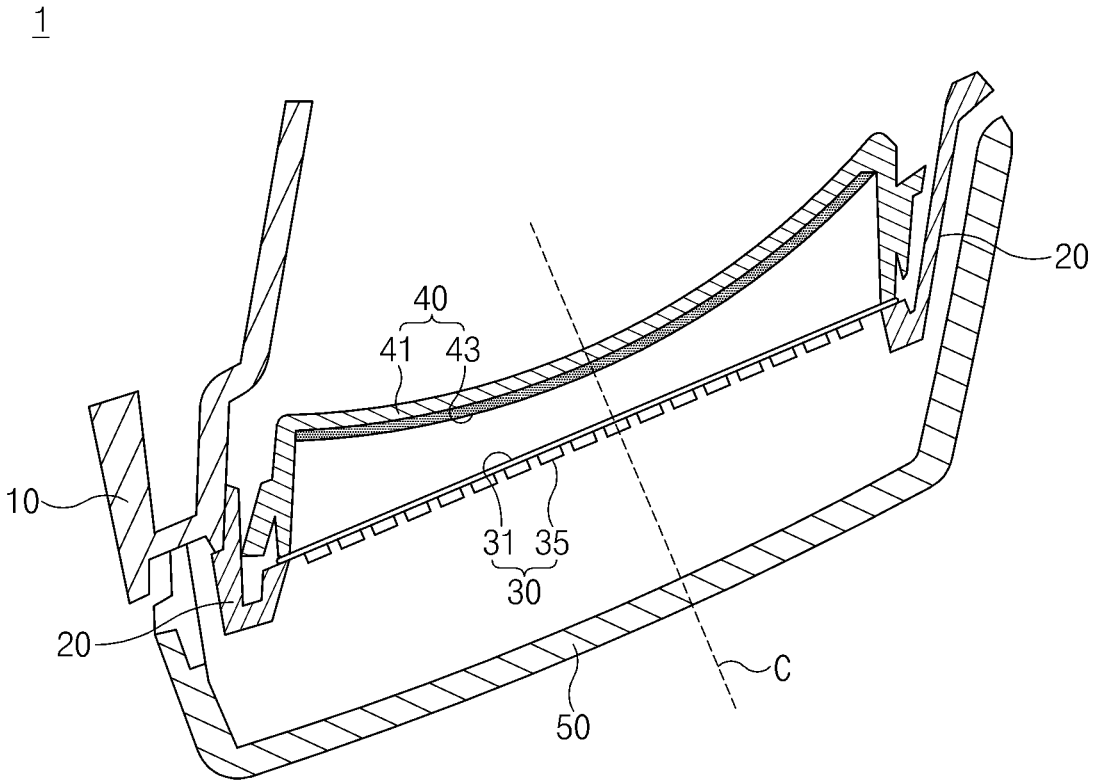
FIG. 1 is a cross-sectional view schematically illustrating a lamp for a vehicle according to an embodiment of the present disclosure.
Figure 2:
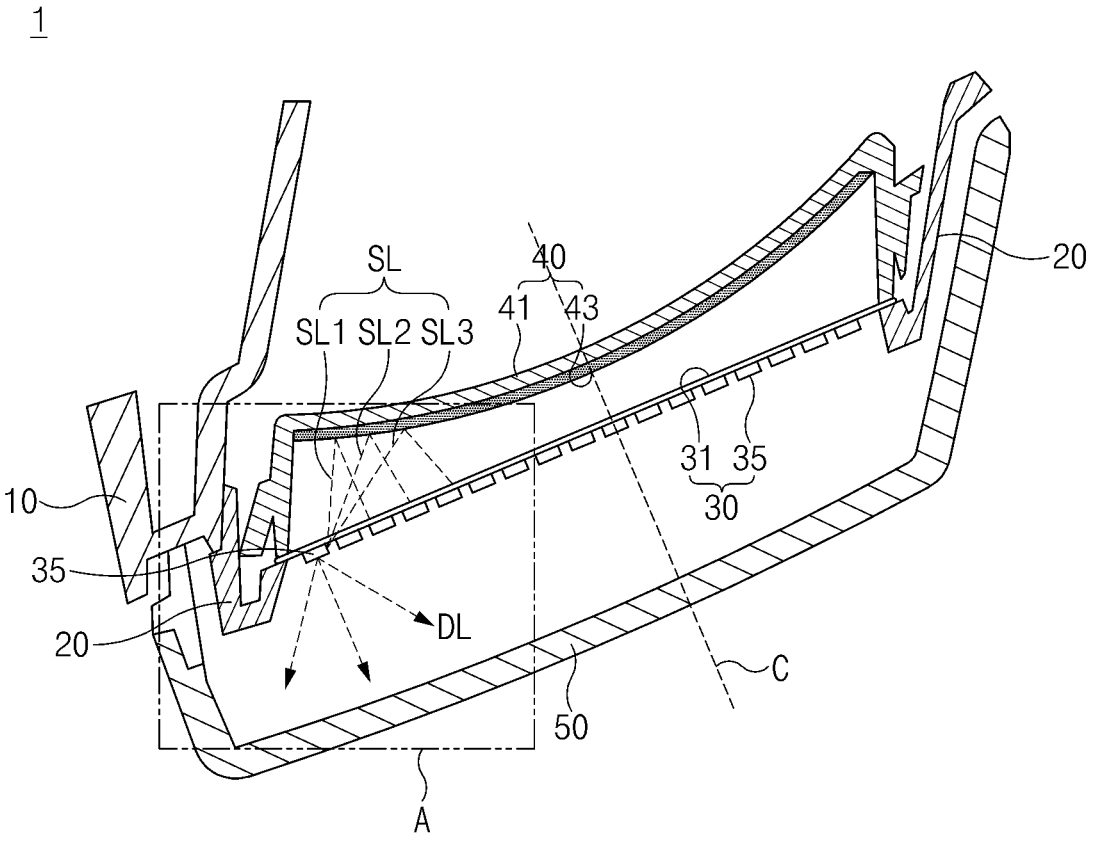
FIG. 2 illustrates a lamp for a vehicle according to an embodiment of the present disclosure, and is a view illustrating rays by some light sources in FIG. 1.
Figure 3:
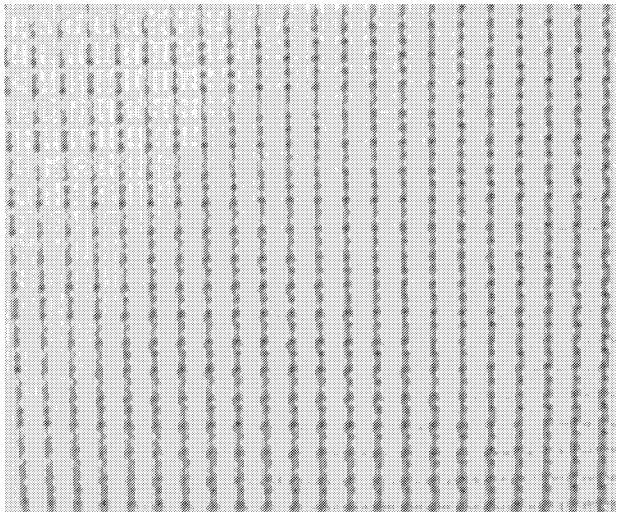
FIG. 3 illustrates an image illustrating an example of a light source part according to the present disclosure.
Figure 4:
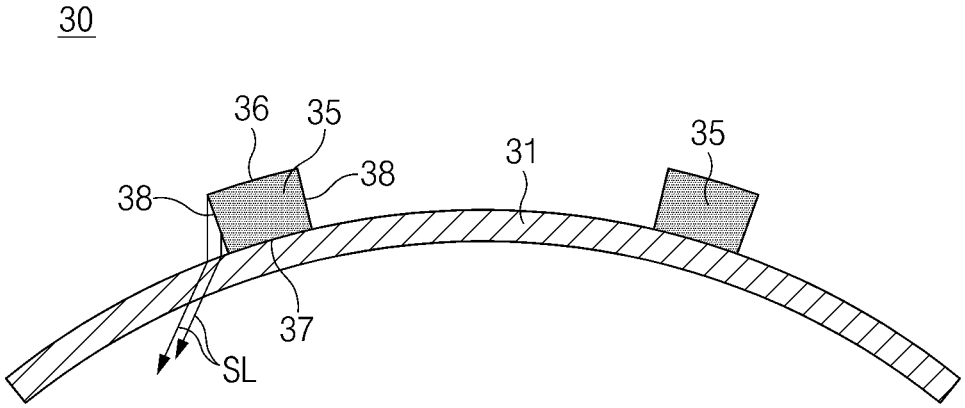
FIG. 4 is a view schematically illustrating a light source part according to an embodiment of the present disclosure, and is a view illustrating refraction of side light of a light source by a board.
Figure 5:
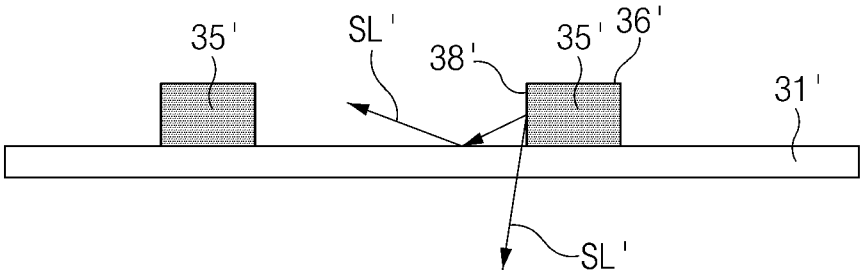
FIG. 5 illustrates a comparative example of a light source part according to the present disclosure, and illustrates that a board is planar.
Figure 6:
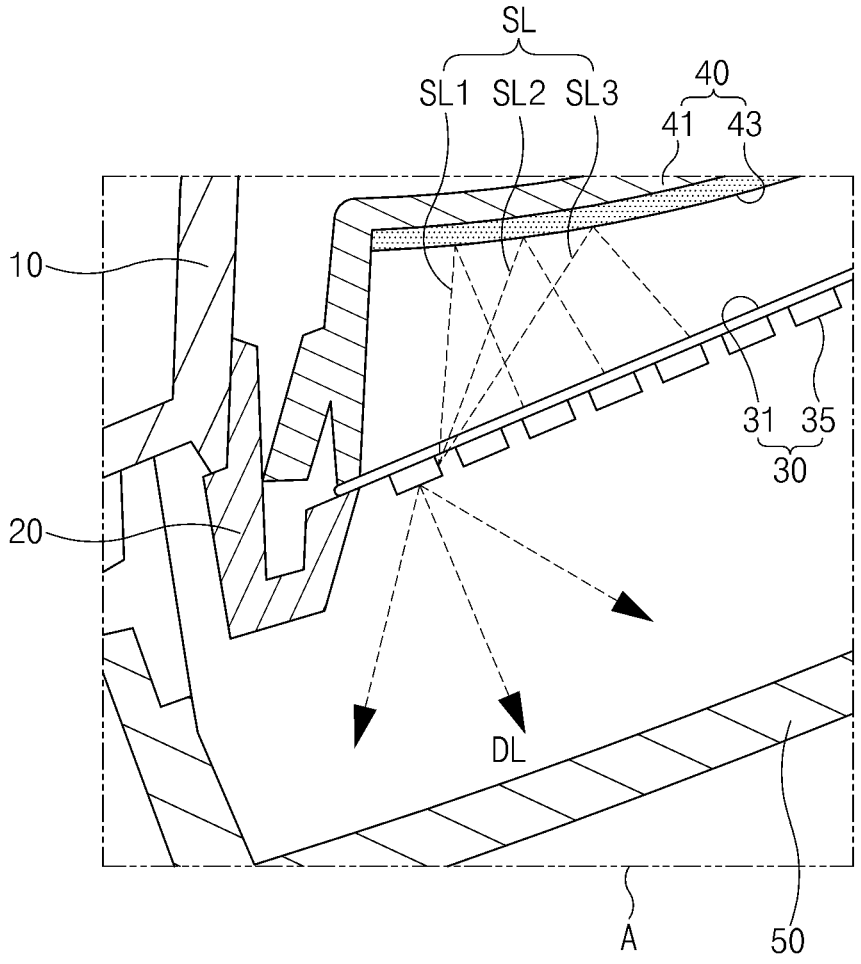
FIG. 6 is an enlarged cross-sectional view of portion A of FIG. 2.

FIG. 1 is a cross-sectional view schematically illustrating a lamp for a vehicle according to an embodiment of the present disclosure. FIG. 2 illustrates a lamp for a vehicle according to an embodiment of the present disclosure, and is a view illustrating rays by some light sources in FIG. 1. FIG. 3 illustrates an image illustrating an example of a light source part according to the present disclosure. FIG. 4 is a view schematically illustrating a light source part according to an embodiment of the present disclosure, and is a view illustrating refraction of side light of a light source by a board. FIG. 5 illustrates a comparative example of a light source part according to the present disclosure, and illustrates that a board is planar. FIG. 6 is an enlarged cross-sectional view of portion A of FIG. 2.

Referring to FIGS. 1 to 6, a lamp 1 for a vehicle according to an embodiment of the present disclosure includes a lamp housing 10, a bezel part 20, a light source part 30, a lens part 50, and a reflection part 40.

The lamp housing 10 is a member that covers components including the bezel part 20, the light source part 30, the lens part 50, and the reflection part 40, and spaces for accommodating the components may be formed.

The bezel part 20 is housed in the lamp housing 10. The bezel part 20 is a part that forms an edge of the lamp, and may be positioned in an interior of the lamp housing 10. As in the illustrated embodiment, the bezel part 20 may function to fix an edge portion of the light source part 30 together with the reflection part 40.

The light source part 30 includes a board 31, in which the bezel part 20 is positioned, and a plurality of light sources 35 positioned on a first surface of the board 31 facing in a front direction toward the lens part 50.

In detail, the board 31 may be a printed circuit board (PCB), in which a specific circuit board is formed. For example, the board 31 may include a flexible printed circuit board (FPCB). The printed circuit board 31 is a circuit board 31 coated with copper foil that is flexibly bent, and is thin and flexible to implement the board 31 according to a shape of a lamp design.

The light source 35 may be a light emitting diode (LED), and a plurality of LEDs may be positioned on the board 31. The plurality of LEDs may be arranged on the board 31 longitudinally and transversely in a matrix form (see FIG. 3). The light sources 35 may be provided in various forms such as an LED chip or an LED package form.

The lens part 50 is positioned on the lamp housing 10, and is configured to externally irradiate light generated by the light source part 30. That is, the light irradiated by the light source part 30 may be emitted externally while passing through the lens part 50.

The reflection part 40 is positioned on and spaced apart from a second surface of the light source part 30. The second surface faces in a rearward direction toward the reflection part 40, which may be opposite to the front direction, and is configured to reflect the light irradiated from the light source part 30 to the front side.

In detail, when it is assumed that a direction, in which the light is irradiated by the lamp 1 for a vehicle is the front side and an opposite direction to the front side is a rear side, the lens part 50 may be disposed on the front side of the light source part 30 and the reflection part 40 may be disposed on the rear side of the light source part 30. That is, the reflection part 40, the light source part 30, and the lens part 50 may be sequentially disposed in an interior of the lamp housing 10 toward the front side. Here, the direction, in which the light is irradiated by the lamp 1 for a vehicle, may be the front side or the rear side in a travel direction of the vehicle. For example, the lamp 1 for a vehicle is a rear lamp, the front side corresponding to the direction, in which the light is irradiated, may be an opposite direction to the travel direction.

Here, the board 31 may be formed of a transparent material having light transmittance. Accordingly, a portion of the light generated by the plurality of light sources 35 may be directed to the reflection part 40 by the board 31.

In detail, the light source 35 may include a front surface 36 that faces the front side, a rear surface 37 corresponding to a surface that faces the rear side and contacts the board 31, and a side surface 38 provided between the front surface 36 and the rear surface 37. Furthermore, a portion of side light SL that is light irradiated from the side surface 38 of the light source 35 may be refracted by the board 31, and may reach the reflection part 40. The light that reaches the reflection part 40 is reflected to the front side.

The light source 35 irradiates most of the light through the front surface 36 that faces the front side, but also irradiates light through the side surface 38. When the light irradiated from the side surface 38 of the light source 25 is the side light SL, the side light SL may be spread radially from the side surface 38. A portion of the side light SL may reach the board 31, and the side light SL that reaches the board 31 may be refracted by the board 31 and reach the reflection part 40 located on the front side.

A portion of the side light SL of the light source 35 is refracted by the board 31 and reaches the reflection part 40, and another portion of the side light SL is refracted by the board 31. A three-dimensional lighting pattern may be formed by the light refracted by the board 31 or the reflection part 40. Then, a three-dimensional feeling of the lighting pattern may be further enhanced as an amount of the side light SL totally refracted by the board 31 becomes larger than an amount of the side light SL refracted by the board 31 and reflected by the reflection part 40.

The board 31 may have a curved surface that is curved toward the front side. That is, the board 31 may be formed to be convex toward the front side, and as described above, this is possible as the board 31 is the flexible circuit board.

Because the board 31 has a curved surface in this way, an amount of the side light SL, which is refracted by the board 31 and reaches the reflection part 30, may be increased. Furthermore, accordingly, the three-dimensional feeling of the lighting pattern may be further enhanced. In detail, when the board 31' has a planar surface as in a comparative example illustrated in FIG. 5, an amount of the side light SL', which is totally refracted by the board 31' is larger than an amount of the side light SL', which is refracted by the board 31' and reaches the reflection part 40. That is, most of the side light SL' irradiated by the side surface 38' of the light source 35' fails to reach the reflection part 40. That is, in the comparative example of FIG. 5, the lighting pattern of the lamp may be formed by the light irradiated from the front surface 36' of the light source 35' and the light totally refracted by the board 31'. In this case, the three-dimensional effect of the lighting pattern may be mere.

Meanwhile, as in the embodiment illustrated in FIG. 4, when the board 31 has a curved surface, an amount of the side light SL that is refracted by the board 31 and reaches the reflection part 40 may be increased as compared with a case in which the board 31 has a planar surface. Through the side light SL that passes through the board 31 and is reflected by the reflection part 40 may further enhance the three-dimensional feeling of the lighting pattern.

In this way, the lamp 1 for a vehicle according to the embodiment of the present disclosure may be configured such that the side light SL of the light sources 35 is refracted and is reflected by the reflection part 40, through the plurality of light sources 35, and the transparent board 31 that has the curved surface. Accordingly, the present disclosure may implement a visual disparity perspective of the lighting pattern through light DL irradiated from the front surface 36 of the light source 35, and the side light SL that is refracted and reflected. Accordingly, the present disclosure may implement the three-dimensional lighting pattern with a simple structure and at low costs.

Meanwhile, the reflection part 40 may include a body 41 and a reflection surface 43.

The body 41 is a main body of the reflection part 40, and may be positioned in the bezel part 20 and be disposed on the rear side of the board 31.

The reflection surface 43 may be formed on a surface that faces the front side of the body 41 and is spaced apart from the board 31, and may be configured to reflect the light irradiated from the light source part 30 to the front side. That is, the reflection surface 43 may be formed on a surface that faces the board 31 of the body 41.

For example, an edge of the body 41 may protrude toward the board 31, and the board 31 may be fixed to the edge of the body 41 by the bezel part 20. The reflection surface 43 may be formed in an area except for the edge of the body 41.

Here, the reflection surface 43 may be formed by depositing a material that reflects light. For example, the reflection surface 43 may be formed by depositing or coating a material having a high reflectivity on a surface that faces the front side of the body 41. As an example, the reflection surface 43 may be formed by depositing aluminum, but the present disclosure is not limited thereto. The reflection part 40 may reflect the side light SL irradiated from the light source 35 to the front side by the reflection surface 43.

Meanwhile, the reflection surface 43 may have a curved surface that is curved toward the front side. That is, the reflection surface 43 may be formed to be convex toward the lens part 50 like the board 31.

In more detail, a surface that is opposite to the board 31 of the body 41 may be curved toward the front side, and the reflection surface 43 may be formed by depositing deposits on the convex surface.

In this way, because the reflection surface 43 is formed to be convex, the side lights SL1, SL2, and SL3 irradiated from the light sources 35 to the reflection surface 43 may be reflected by the reflection surface 43 at different angles according to incident angles. Here, the side light SL irradiated from the light source may form at least two images on the reflection surface 43. Accordingly, the present disclosure may implement a three-dimensional feeling of the light pattern by the images formed on the reflection surface 43.

For example, referring to FIGS. 2 and 6, the plurality of side lights SL1, SL2, and SL3 that pass through the board 31 from one light source 35 and reaches the reflection part 40 may reach different points of the reflection surface 43, and the three-dimensional light pattern may be formed by the convex shape of the reflection surface 43.

Furthermore, because the reflection surface 43 has a curved surface to be curved toward the front side, visibility may be enhanced through lighting in a wide range.

Meanwhile, to form an image on the reflection surface 43 with the side light SL of the light source 35, the curvatures of the board 31 and the reflection surface 43 have to be different. In detail, the curvature of the reflection surface 43 may be formed to be larger than the curvature of the board 31. That is, a radius of curvature of the reflection surface 43 may be formed to be smaller than a radius of curvature of the board 31.

In this way, because the curvature of the reflection surface 43 is formed to be larger than the curvature of the board 31, a three-dimensional feeling effect using a binocular disparity may be maximized.

Meanwhile, the curved surface shape of the board 31 and the curved surface shape of the reflection surface 43 may be various curved surface shapes as long as they are formed to be convex in a direction that faces the lens part 50.

For example, the board 31 and the reflection surface 43 may be symmetrical to each other with respect to a vertical center surface corresponding to an imaginary surface obtained by extending a central axis "C" passing through a center of the light source part and extending in a direction, in which the light is irradiated by the lamp 1 for a vehicle.

Hereinafter, an axis that passes through a center of the board 31 and extends toward the front side with respect to a light irradiation direction is defined as the central axis "C", and an imaginary surface obtained by extending the central axis "C" in a direction that is perpendicular to a ground surface is defined as a vertical center surface. Then, the board 31 and the reflection surface 43 may be symmetrical to each other leftwards and rightwards with respect to the vertical center surface.

For example, the board 31 and the reflection surface 43 may be asymmetrical to each other with respect to a vertical center surface corresponding to an imaginary surface obtained by extending a central axis "C" passing through a center of the light source part 30 and extending in a direction, in which the light is irradiated by the lamp 1 for a vehicle.

That, the board 31 and the reflection surface 43 may be asymmetrical to each other leftwards and rightwards with respect to the vertical center surface. Meanwhile, in this case, the board 31 and the reflection surface 43 may be formed to be similar to each other with respect to the vertical center surface.

Here, a distance between the board 31 and the reflection surface 43 may be shortest at a center of the light source part 30.

In detail, the distance between the board 31 and the reflection surface 43 may be shortest in the central axis "C". This is because the board 31 and the reflection surface 43 are formed to be convex toward the front side, the curvature of the reflection surface 43 is larger than the curvature of the board 31, and the left and right sides of the board 31 and the reflection surface 43 are similar to each other with respect to the vertical center surface. Meanwhile, the distance between the board 31 and the reflection surface 43 is not limited thereto.

Meanwhile, for example, the lamp 1 for a vehicle may be a rear lamp positioned on the rear surface of the vehicle.

In detail, the lamp 1 for a vehicle according to the present disclosure is positioned on a rear side of the vehicle and may be configured to irradiate light toward an opposite direction to a travel direction of the vehicle. The lamp 1 for a vehicle may be lamps having various functions, such as back lamps, brake lamps, and the like, as long as it is positioned on the rear surface of the vehicle. However, the lamp 1 for a vehicle according to the present disclosure is not limited to the rear lamp, but may be applied to headlamps and the like.

In this way, the lamp for a vehicle according to the embodiment of the present disclosure may form a three-dimensional lighting pattern by implementing a visual disparity perspective while the side light of the light source is refracted by the board and reflected by the reflection part. Furthermore, according to the present disclosure, the reflection part has a convex shape so that the three-dimensional feeling may be enhanced and visibility may be improved by securing a sufficient light irradiation area.

Furthermore, according to the present disclosure, because the curvature of the reflection surface is larger than the curvature of the board, an amount of the side light of the light source, which is refracted by the board and reaches the reflection surface, may be increased. Furthermore, according to the present disclosure, costs for forming a three-dimensional lighting pattern may be saved by implementing a three-dimensional effect with a simple structure.

Although the specific embodiments of the present disclosure have been described until now, the spirit and scope of the present disclosure are not limited to the specific embodiments, and may be variously corrected and modified by an ordinary person in the art, to which the present disclosure pertains, without changing the essence of the present disclosure claimed in the claims.

What is claimed is:

1. A lamp for a vehicle, comprising:

a lamp housing;

a bezel part housed in the lamp housing;

a light source part including (a) a board positioned in the bezel part and having first and second surfaces facing respectively in opposite directions and (b) a plurality of light sources positioned on the first surface of the board and configured to generate light;

a lens part facing and spaced apart from the first surface of the light source part and configured to externally irradiate the light generated by the light source part; and a reflection part facing and spaced apart from a second surface of the light source part and configured to reflect the light generated by the light source part, wherein the board comprises a transparent material configured to direct a portion of the light generated by the plurality of light sources toward the reflection part, wherein the reflection part includes:

a body having a main surface facing the second surface of the board; and a reflection surface disposed on the main surface of the body, spaced apart from the board, and configured to reflect the portion of the light directed toward the reflection part by the board toward the lens part, and wherein (1) the reflection surface of the reflection part has a first curved surface having a center portion protruding toward the board, (2) the first surface of the board has a second curved surface having a center portion protruding toward the lens part, and (3) a curvature of the first curved surface of the reflection surface is greater than that of the second curved surface of the first surface of the board.

2. The lamp of claim 1, wherein:

each of the light sources includes:

a front surface facing in a first direction toward the lens part;

a rear surface facing in a second direction toward the reflection part and in contact the board; and a side surface provided between the front surface and the rear surface, and the portion of the light directed toward the reflection part by the board includes a portion of side light irradiated from the side surface of the light source and refracted by the board toward the reflection part.

3. The lamp of claim 1, wherein the board has a curved surface having a center portion protruding toward the board.

4. The lamp of claim 1, wherein the board comprises a flexible printed circuit board (FPCB).

5. The lamp of claim 1, wherein the body of the reflection part is positioned in the bezel part.

6. The lamp of claim 1, wherein the reflection surface comprises a light-reflecting material.

7. The lamp of claim 1, wherein the reflection surface has a first curved surface having a center portion protruding toward the board.

8. The lamp of claim 1, wherein the board and the reflection surface are symmetrical with respect to an imaginary surface extending through a center of the light source part.

9. The lamp of claim 1, wherein the board and the reflection surface are asymmetrical with respect to an imaginary surface extending through a center of the light source part.

10. The lamp of claim 1, wherein a distance between the board and the reflection surface is shortest at a center of the light source part.

11. The lamp of claim 1, wherein the lamp comprises a rear lamp of the vehicle.

* * * * *